US011747753B2

(12) United States Patent
Kobayashi et al.

(10) Patent No.: US 11,747,753 B2
(45) Date of Patent: Sep. 5, 2023

(54) IMAGE FORMING APPARATUS CONFIGURED TO CONTROL THE VOLTAGE APPLIED TO THE TRANSFER MEMBER TO SUPPRESS IMAGE DEFECTS

(71) Applicant: CANON KABUSHIKI KAISHA, Tokyo (JP)

(72) Inventors: Shinsuke Kobayashi, Yokohama (JP); Kazuhiro Funatani, Kawasaki (JP); Kensuke Umeda, Kawasaki (JP); Takanori Watanabe, Kawasaki (JP); Ai Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/567,456

(22) Filed: Jan. 3, 2022

(65) Prior Publication Data

US 2022/0121140 A1 Apr. 21, 2022

Related U.S. Application Data

(63) Continuation of application No. 17/005,160, filed on Aug. 27, 2020, now Pat. No. 11,243,485.

(30) Foreign Application Priority Data

Aug. 29, 2019 (JP) ..... 2019-157415

(51) Int. Cl.
*G03G 15/16* (2006.01)
*G03G 15/00* (2006.01)

(52) U.S. Cl.
CPC ..... *G03G 15/1675* (2013.01); *G03G 15/80* (2013.01)

(58) Field of Classification Search
USPC ..... 399/66
See application file for complete search history.

(56) References Cited

U.S. PATENT DOCUMENTS

2006/0285873 A1* 12/2006 Saeki ..... G03G 15/168 399/101
2018/0095385 A1* 4/2018 Asami ..... G03G 15/0865

FOREIGN PATENT DOCUMENTS

EP 563478 A2 * 10/1993 ..... G03G 15/0266
JP H04-134379 A 5/1992
JP H04-296785 A 10/1992

(Continued)

*Primary Examiner* — Quana Grainger
(74) *Attorney, Agent, or Firm* — Canon U.S.A., Inc. I.P. Division

(57) ABSTRACT

An image forming apparatus includes a photosensitive member, a transfer member, a transfer power source, and a control unit. At a start time of a start-up operation at the time of starting an image forming operation, on the surface of the photosensitive member, a first position coincides with a charging position, and a third position coincides with a transfer position. During a period in which an area on the photosensitive member located between the first position and the third position in a rotation direction of the photosensitive member passes the transfer position, the control unit performs control of applying a first voltage having the same polarity as a normal charging polarity of toner to the transfer member by the transfer power source, and, at a predetermined timing, changing a voltage from the first voltage to a second voltage having an absolute value less than that of the first voltage.

12 Claims, 8 Drawing Sheets

(56) References Cited

FOREIGN PATENT DOCUMENTS

| | | | | | |
|---|---|---|---|---|---|
| JP | H05-281862 | A | | 10/1993 | |
| JP | 2003-173123 | A | | 6/2003 | |
| JP | 2019032426 | A | * | 2/2019 | ..... G03G 15/0189 |

* cited by examiner

IMAGE FORMING APPARATUS CONFIGURED TO CONTROL THE VOLTAGE APPLIED TO THE TRANSFER MEMBER TO SUPPRESS IMAGE DEFECTS

CROSS-REFERENCE TO RELATED APPLICATIONS

The present application is a continuation of U.S. patent application Ser. No. 17/005,160, filed on Aug. 27, 2020, which claims priority from Japanese Patent Application No. 2019-157415 filed Aug. 29, 2019, which are hereby incorporated by reference herein in their entireties.

BACKGROUND OF THE DISCLOSURE

Field of the Disclosure

The present disclosure relates to an image forming apparatus such as a printer, a copying machine, or a facsimile apparatus using an electrophotographic method.

Description of the Related Art

Hitherto, an image forming apparatus using an electrophotographic method uniformly charges a surface of a rotatable photosensitive member through use of a charging member and exposes the charged surface of the photosensitive member to light in accordance with image information, thereby forming an electrostatic image on the photosensitive member. Moreover, the image forming apparatus develops the electrostatic image formed on the photosensitive member with toner through use of a developing device to form a toner image on the photosensitive member and transfers the toner image to a recording material such as a paper sheet. Moreover, transfer residual toner which remains on the photosensitive member after the transfer is removed and collected from the photosensitive member through use of a cleaning member. A rotatable drum-type (cylindrical) photosensitive drum is used as the photosensitive member in many cases, and a cleaning blade is used as the cleaning member in many cases. Thus, in the following, the photosensitive drum and the cleaning blade are described as examples.

Examples of a developing method used in such an image forming apparatus include a one-component developing method using a one-component developer formed only of toner and a two-component developing method using a two-component developer formed of toner and a carrier. The one-component developing method has a merit that a configuration of the developing device can be simplified as compared to the case of the two-component developing method. A developing device using the one-component developing method allows the toner to be borne on a surface of a development member and then allows the toner to be brought into friction contact with a regulation member along with movement of the surface of the development member. As a result, the toner on the development member is frictionally charged, and a layer thickness of the toner on the development member is regulated, thereby forming a thin toner layer on the development member. Further, along with the movement of the surface of the development member, the toner on the development member in the thin-layer state is conveyed to a development area in which the photosensitive drum and the development member are opposed to each other, and a developing voltage is applied to the development member, thereby causing the toner to move to the photosensitive drum with an electrical force. The development member is brought into contact with the surface of the photosensitive drum in the development area or is brought close to the surface of the photosensitive drum in the development area. A rotatable roller-shaped developing roller is used as the development member in many cases, and a blade-shaped developing blade is used as the regulation member in many cases. Thus, in the following, the developing roller and the developing blade are described as examples. Moreover, the case in which the developing roller is brought into contact with the photosensitive drum is described as an example.

In the image forming apparatus using the one-component developing method, at the time of a start-up operation when starting an image forming operation, an area on the photosensitive drum which has not been charged passes through the development area. At this time, a phenomenon called "start-up fog" occurs, in which the toner on the development member moves onto the photosensitive drum in the development area. Even though the amount of toner to be consumed by the start-up fog in each image forming operation is minute, the toner consumption amount increases as the start-up fog repeatedly occurs. Moreover, when the start-up fog occurs, the toner having moved onto the photosensitive drum due to the start-up fog adheres to a transfer member configured to transfer the toner image on the photosensitive drum to a recording material, causing dirt on the back of the recording material.

In Japanese Patent Application Laid-Open No. H11-212360, the following configuration is disclosed. Specifically, before termination of rotation of a development member, a collecting voltage having an absolute value less than that of a developing voltage is applied to a toner supply member and a developing blade, which are in contact with the development member. In such a manner, before the termination of the rotation of the development member, the toner on a surface of the development member is collected, thereby reducing the amount of toner that moves from the development member onto the photosensitive drum at the time of the next start-up operation.

However, even when the method disclosed in Japanese Patent Application Laid-Open No. H11-212360 is used, it is sometimes difficult to eliminate the toner on the development member at the time of starting the start-up operation, and there is a possibility that the toner on the development member moves onto the photosensitive drum at the time of the start-up operation to cause the start-up fog.

SUMMARY OF THE DISCLOSURE

One aspect of the present disclosure is to suppress image defects caused by toner in such a case that a phenomenon in which toner moves from a development member to a photosensitive member at the time of a start-up operation occurs.

According to an embodiment of the present disclosure, there is provided an image forming apparatus including: a photosensitive member which is rotatable; a charging member configured to charge a surface of the photosensitive member and disposed at a charging position with respect to a rotation direction of the photosensitive member; an exposure device configured to expose the surface of the photosensitive member, which is charged by the charging member, and disposed at an exposure position with respect to the rotation direction of the photosensitive member, to form an electrostatic image on the photosensitive member; a developing device including: a developing member, which is rotatable, disposed opposite to the photosensitive member at a development position with respect to the rotation direction of the photosensitive member and configured to bear toner; and a regulation member disposed at a regulating position with respect to a rotation direction of the development member and configured to regulate the toner on the development member, wherein the developing device is configured to supply, at the development position, the toner on the development member which is regulated by the regulation member and conveyed to a supply position with respect to the rotation direction of the development member to the electrostatic image on the photosensitive member to form a toner image on the photosensitive member; a transfer member which is urged toward the photosensitive member at a transfer position with respect to the rotation direction of the photosensitive member; a transfer power source configured to apply a voltage to the transfer member; and a control unit configured to control the transfer power source, wherein, at a start time of a start-up operation at a time of starting an image forming operation, on the surface of the photosensitive member, a first position coincides with the charging position, a second position coincides with the development position, and a third position coincides with the transfer position, and on the surface of the development member, a fourth position coincides with the regulating position, and a fifth position coincides with the supply position, wherein during a period in which an area on the photosensitive member located between the first position and the third position with respect to the rotation direction of the photosensitive member passes the transfer position, the control unit performs control of applying a first voltage having a same polarity as a normal charging polarity of the toner to the transfer member by the transfer power source and, at a predetermined timing after the first voltage is applied, changing a voltage applied to the transfer member from the first voltage to a second voltage having an absolute value less than an absolute value of the first voltage.

Further features and aspects of the present disclosure will become apparent from the following description of example embodiments with reference to the attached drawings.

DESCRIPTION OF THE EMBODIMENTS

Now, an image forming apparatus according to an embodiment of the present disclosure is described in detail with reference to the drawings.

First Embodiment

1. Overall Configuration and Operation of Image Forming Apparatus

Figure 1:
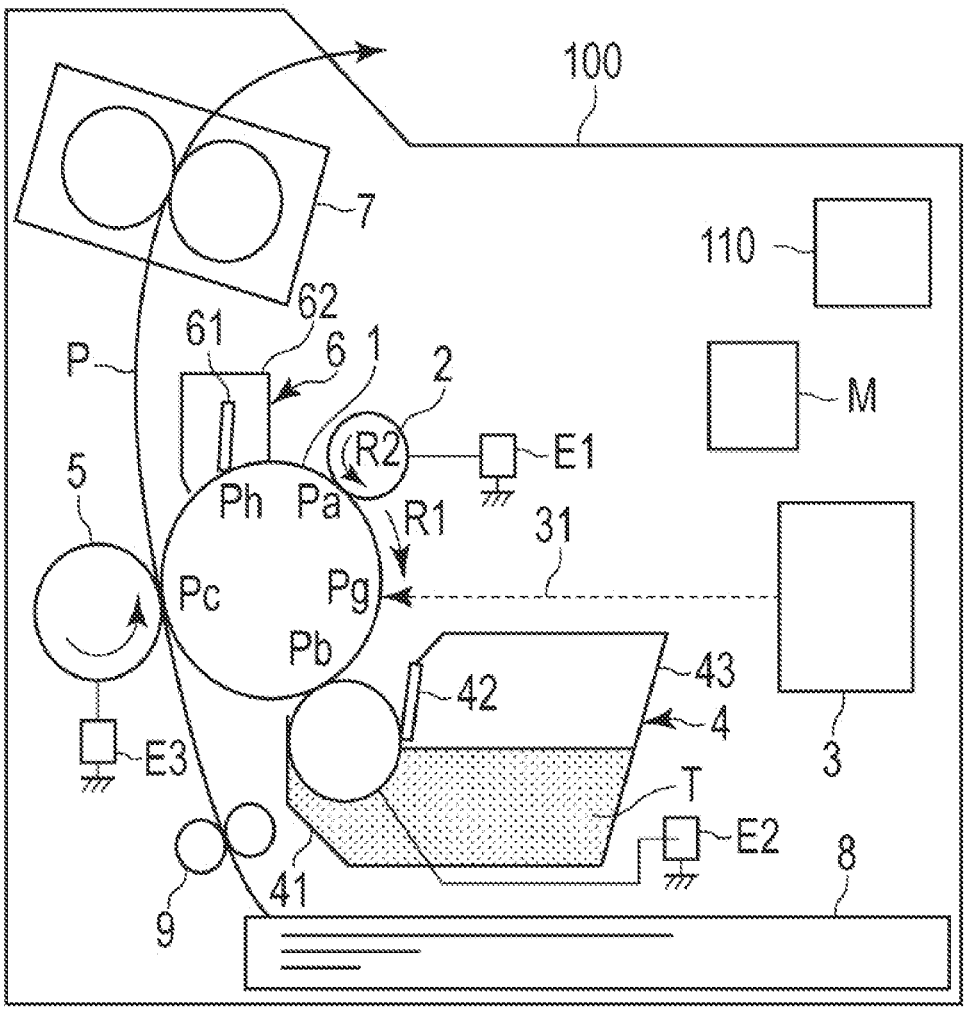
FIG. 1 is a schematic sectional view for illustrating an image forming apparatus.

FIG. 1 is a schematic sectional view for illustrating an image forming apparatus 100 according to a first embodiment. The image forming apparatus 100 according to the first embodiment is a laser beam printer using an electrophotographic method.

The image forming apparatus 100 includes a photosensitive drum 1, which is a rotatable drum-type (cylindrical) photosensitive member (electrophotographic photosensitive member) serving as an image bearing member configured to bear a toner image. When an image forming operation (job) is started, the photosensitive drum 1 is driven to rotate in an arrow R1 direction (clockwise direction) of FIG. 1 by a drive motor serving as a drive source. In this embodiment, the photosensitive drum 1 has an outer diameter of 20 mm and has a circumferential speed (moving speed of a surface) of 160 mm/sec. A surface of the photosensitive drum 1 being rotated is uniformly charged to a predetermined potential having a predetermined polarity (negative polarity in this embodiment) by a charging roller 2 being a roller-type charging member serving as a charging unit. In this embodiment, the charging roller 2 is a conductive elastic roller, and is formed of a metal core and a conductive elastic layer provided around the metal core. The charging roller 2 is arranged in contact with the photosensitive drum 1, and is driven to rotate in an arrow R2 direction (counterclockwise direction) of FIG. 1 by a drive motor serving as a drive source. The charging roller 2 may be configured to follow the rotation of the photosensitive drum 1 to rotate. At the time of a charging process, a predetermined charging voltage (charging bias) being a direct-current voltage having a negative polarity is applied to the charging roller 2 from a charging power source E1 serving as a charging-voltage applying unit. A position at which the photosensitive drum 1 is to be charged by the charging roller 2 is a charging position Pa. The charging roller 2 is disposed a the charging position Pa and configured to charge the surface of the photosensitive drum 1 through electric discharge that occurs in at least one of minute gaps defined between the charging roller 2 and the photosensitive drum 1 upstream and downstream of a contact portion (abutment portion) between the charging roller 2 and the photosensitive drum 1 in the rotation direction of the photosensitive drum 1. However, for ease of understanding of the present disclosure, description is made with the assumption that the contact portion between the charging roller 2 and the photosensitive drum 1 corresponds to the charging position Pa.

The charged surface of the photosensitive drum 1 is scanned with and exposed to a laser beam 31, which is radiated from an exposure device (laser beam scanner) 3 serving as an exposure unit and is modulated in accordance with image information (image data), thereby forming an electrostatic image (electrostatic latent image) on the photosensitive drum 1. A position at which the exposure by the exposure device 3 is performed is an exposure position Pg. The exposure device 3 is configured to expose the surface of the photosensitive drum 1 at the exposure position Pg, which is located on a circular path in which the surface of the photosensitive drum 1 moves when the photosensitive drum 1 is rotated.

The electrostatic latent image formed on the photosensitive drum 1 is developed (formed into a visible image) through supply of toner T serving as a developer by a developing device 4 serving as a developing unit, thereby forming a toner image on the photosensitive drum 1. At the time of a developing process, a predetermined developing voltage (developing bias) being a direct-current voltage having a negative polarity is applied from a development power source E2 serving as a developing-voltage applying unit to a developing roller (development member) 41 provided to the developing device 4. A position at which the supply of toner from the developing roller 41 to the electrostatic image on the photosensitive drum 1 is performed is a development position Pb. In this embodiment, a contact portion (abutment portion) with respect to the developing roller 41 on the photosensitive drum 1 corresponds to the development position Pb. In this embodiment, a normal charging polarity of the toner, which is a charging polarity of the toner given at the time of development, is a negative polarity. The developing device 4 is described later more in detail.

A transfer roller 5 being a roller-type transfer member serving as a transfer unit is arranged so as to be opposed to the photosensitive drum 1. The transfer roller 5 is arranged in contact with the photosensitive drum 1 and follows the rotation of the photosensitive drum 1 to rotate. The transfer roller 5 may be configured to be driven to rotate by a drive motor serving as a drive source. A position at which the transfer of the toner image from the photosensitive drum 1 onto a recording material P is performed is a transfer position Pc. In this embodiment, a contact portion (abutment portion) with respect to the transfer roller 5 on the photosensitive drum 1 corresponds to the transfer position Pc. The toner image formed on the photosensitive drum 1 is sent to the transfer position Pc along with the rotation of the photosensitive drum 1. Meanwhile, in synchronization with the timing of the toner image on the photosensitive drum 1, the recording material P such as a recording sheet serving as a transfer material is conveyed from a recording-material accommodating portion 8 by, for example, conveyance rollers 9. Then, the toner image on the photosensitive drum 1 is transferred onto the recording material P, which is conveyed while being sandwiched between the photosensitive drum 1 and the transfer roller 5, by an action of the transfer roller 5 at the transfer position Pc. That is, the transfer roller 5 transfers the toner image from the photosensitive drum 1 to the recording material P which passes through the contact portion between the photosensitive drum 1 and the transfer roller 5. At the time of a transfer process, a predetermined transfer voltage (transfer bias) being a direct-current voltage having a polarity (positive polarity in this embodiment) opposite to the normal charging polarity of the toner is applied from a transfer power source E3 serving as a transfer-voltage applying unit to the transfer roller 5. As a result, an electric field is formed between the transfer roller 5 and the photosensitive drum 1, thereby electrostatically transferring the toner image from the photosensitive drum 1 to the recording material P. In this embodiment, the transfer power source E3 is capable of applying a direct-current voltage having the negative polarity and a direct-current voltage having the positive polarity to the transfer roller 5.

The recording material P having the toner image transferred thereto is sent to a fixing device 7 serving as a fixing unit. The fixing device 7 applies heat and pressure to the recording material P bearing the unfixed toner image, thereby fixing (melting and fixing) the toner image on the recording material P. The recording material P having the toner image fixed thereon is delivered (output) to an outside of an apparatus main body of the image forming apparatus 100.

Moreover, transfer residual toner which remains on the photosensitive drum 1 without being transferred to the recording material P at the time of the transfer process is removed and collected from the photosensitive drum 1 through use of a cleaning device 6 serving as a cleaning unit. The cleaning device 6 uses a cleaning blade 61, which is arranged in abutment against the photosensitive drum 1 and serves as a cleaning member, to scrape off the transfer residual toner from the surface of the photosensitive drum 1 being rotated and collect the transfer residual toner into a cleaning container 62. In this embodiment, the cleaning blade 61 is made of urethane rubber serving as an elastic material and is held in pressure contact with the surface of the photosensitive drum 1 at a predetermined pressure. The cleaning blade 61 is a plate-shaped (blade-shaped) member having a predetermined length in each of a longitudinal direction, which is arranged substantially parallel to a rotation axis direction of the photosensitive drum 1, and a short direction, which is substantially orthogonal to the longitudinal direction, and having a predetermined thickness. The cleaning blade 61 is arranged in a counter direction with respect to the rotation direction of the photosensitive drum 1 so that an end portion thereof on a free end side in the short direction is directed toward the upstream side in the rotation direction of the photosensitive drum 1, and is in abutment against the surface of the photosensitive drum 1 at an edge of the end portion on the free end side. A position at which the cleaning by the cleaning device 6 is performed is a cleaning position Ph. In this embodiment, a contact portion (abutment portion) between the cleaning blade 61 and the photosensitive drum 1 corresponds to the cleaning position Ph. The cleaning blade 61 is in abutment against the photosensitive drum 1 more on the downstream side than the transfer position Pc and more on the upstream side than the charging position Pa in the rotation direction of the photosensitive drum 1, and removes the toner from the photosensitive drum 1.

At the time of terminating the series of image forming operations, the surface of the photosensitive drum 1 is subjected to charge-removal processing (optical charge-removal processing in this embodiment) along a circumference corresponding to at least one rotation of the photosensitive drum 1 with the laser beam 31 emitted from the exposure device 3 serving as a charge removal unit. As a result of the charge-removal processing, a surface potential of the photosensitive drum 1 is initialized to approximately 0 V throughout an entire region, thereby setting the photosensitive drum 1 ready for the next image forming operation.

In this embodiment, the photosensitive drum 1 and the charging roller 2, the developing device 4, and the cleaning device 6, which serve as a process unit configured to act on the photosensitive drum 1 integrally form a process cartridge which is attachable to and detachable from the apparatus main body of the image forming apparatus 100.

2. Developing Device

Figure 2:
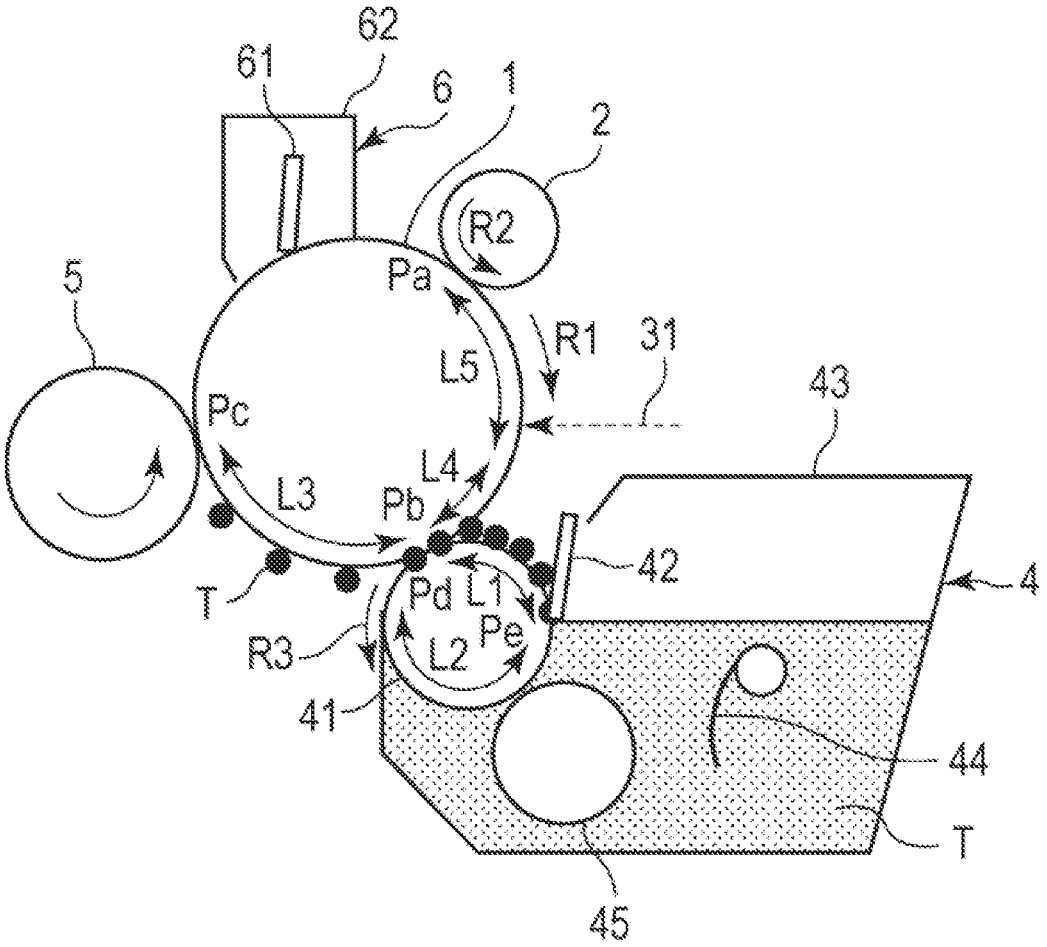
FIG. 2 is a schematic sectional view for illustrating the surroundings of a photosensitive drum.

Next, the developing device 4 in this embodiment is described more in detail. FIG. 2 is a schematic sectional view for illustrating the surroundings of the photosensitive drum 1 including the developing device 4 in this embodiment (in cross section which is substantially orthogonal to the rotation axis direction of the photosensitive drum 1).

In this embodiment, the developing device 4 uses a one-component developer (in particular, non-magnetic one-component developer) formed only of the toner T as a developer to perform development by bringing the developing roller 41 into contact with the photosensitive drum 1. The developing device 4 includes the developing roller 41 serving as a development member (developer bearing member), a developing blade 42 serving as a regulation member, a developing container 43, a stirring member 44, and a supply roller 45 serving as a supply member. The developing roller 41 is arranged so as to be opposed to the photosensitive drum 1, and is configured to bear and convey the toner T to supply the toner T onto the photosensitive drum 1. The developing blade 42 is arranged so as to be opposed to the developing roller 41, and is configured to regulate the amount of the toner T on the developing roller 41 to form the toner T into a predetermined thin layer and frictionally charge the toner T. The developing container 43 is configured to store the toner T and support the developing roller 41, the developing blade 42, the stirring member 44, and the supply roller 45. The stirring member 44 is configured to stir the toner T stored in the developing container 43 and convey the toner T to the developing roller 41. The supply roller 45 is configured to supply the toner T onto the developing roller 41 and scrape off the toner T, which has not been used for the development, from the developing roller 41.

The developing roller 41 is an elastic multi-layer roller including an elastic layer, which is formed of a base layer and a top layer, around a metal core made of metal. In this embodiment, urethane rubber is used as a material of the base layer, and urethane rubber containing carbon mixed therein is used as a material of the top layer. However, a configuration of the developing roller 41 is not limited to this configuration. For example, the elastic layer may be formed of a single layer and be made of ether urethane or nylon. Moreover, a developing sleeve including a conductive elastic rubber layer provided around a hollow non-magnetic metal tube may be used. The developing roller 41 is arranged such that a part of the developing roller 41 is exposed to the outside at an opening portion provided at a position of the developing container 43 being opposed to the photosensitive drum 1. The developing roller 41 is driven to rotate in an arrow R3 direction (counterclockwise direction) of FIG. 2 by a drive motor serving as a drive source. That is, the developing roller 41 is driven to rotate in such a direction that a moving direction of the surface of the photosensitive drum 1 and a moving direction of the surface of the developing roller 41 are the same at an opposing portion between the photosensitive drum 1 and the developing roller 41. Moreover, in this embodiment, the developing roller 41 is driven to rotate such that the moving speed of the surface of the developing roller 41 (circumferential speed) is 1.2 times as fast as the moving speed of the surface of the photosensitive drum 1 (circumferential speed).

The developing container 43 stores the toner T of black, which is a non-magnetic one-component developer serving as a developer. The normal charging polarity (charging polarity given at the time of development) of the toner T of this embodiment is the negative polarity. The toner T stored in the developing container 43 is stirred by the stirring member 44, and is supplied to the surface of the developing roller 41 by the supply roller 45. The toner T having been supplied to the surface of the developing roller 41 passes through an opposing portion between the developing roller 41 and the developing blade 42 along with the rotation of the developing roller 41, thereby being evenly formed into a thin layer and being charged to the negative polarity due to the frictional charging. After that, the toner T on the developing roller 41 is conveyed to the opposing portion between the photosensitive drum 1 and the developing roller 41 along with the rotation of the developing roller 41, and is moved to the photosensitive drum 1 in accordance with the electrostatic image on the photosensitive drum 1, thereby developing the electrostatic image on the photosensitive drum 1. In this embodiment, the toner image is formed through image-portion exposure and reversal development. That is, the toner T having been charged to the same polarity (negative polarity in this embodiment) as the charge potential of the photosensitive drum 1 adheres to an exposure portion (image portion) on the photosensitive drum 1 at which an absolute value of the potential has become smaller due to the exposure after being uniformly charged.

A position at which the supply of toner from the developing roller 41 to the electrostatic image on the photosensitive drum 1 is performed is a supply position Pd. In this embodiment, a contact portion (abutment portion) on the developing roller 41 with respect to the photosensitive drum 1 corresponds to the supply position Pd. Moreover, a position at which the layer thickness of the toner is regulated by the developing blade 42 is a regulating position Pe. In this embodiment, a contact portion (abutment portion) on the developing roller 41 with respect to the developing blade 42 corresponds to the regulating position Pe. Moreover, the supply roller 45 scrapes off the toner T from the developing roller 41 and supplies the toner T to the developing roller 41 at a supply/scrape-off position on the developing roller 41, which is located more on the downstream side than the supply position Pd and more on the upstream side than the regulating position Pe in the rotation direction of the developing roller 41.

3. Drive Source and Other Components

In this embodiment, the same drive motor is used in common as the drive source for the photosensitive drum 1, the charging roller 2, and the developing roller 41. That is, in this embodiment, the photosensitive drum 1, the charging roller 2, and the developing roller 41 are driven to rotate with the drive force transmitted via respective drive transmission systems from a main motor M being the drive motor used in common. As mentioned above, the charging roller 2 may follow the photosensitive drum 1 to rotate. Moreover, as mentioned above, the transfer roller 5 may be driven to rotate. In that case, the transfer roller 5 may be driven to rotate by the main motor M used in common.

Moreover, in this embodiment, the image forming apparatus 100 does not include a contact/separation unit configured to bring the developing roller 41 into and out of contact with the photosensitive drum 1 (move the developing roller 41 in a separation direction and a contact direction) in a state in which the developing device 4 (process cartridge) is mounted to the apparatus main body of the image forming apparatus 100. In this embodiment, in the state in which the developing device 4 (process cartridge) is mounted to the apparatus main body of the image forming apparatus 100, the developing roller 41 is maintained in a state of abutting against the photosensitive drum 1.

Moreover, in this embodiment, the image forming apparatus 100 does not include a contact/separation unit configured to bring the transfer roller 5 into and out of contact with the photosensitive drum 1 in a state in which the photosensitive drum 1 (process cartridge) is mounted to the apparatus main body of the image forming apparatus 100. In this embodiment, in the state in which the photosensitive drum 1 (process cartridge) is mounted to the apparatus main body of the image forming apparatus 100, the transfer roller 5 is maintained in a state of abutting against the photosensitive drum 1.

4. Voltage Control at the Time of Start-Up Operation

Figure 3:
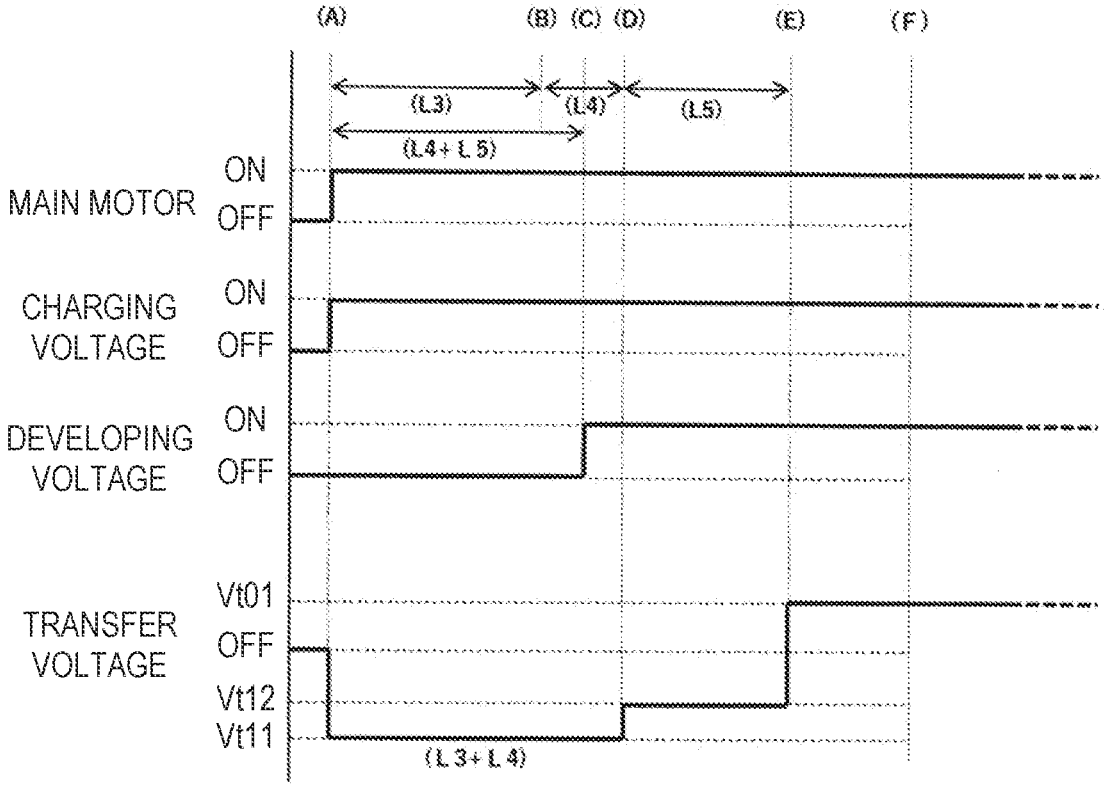
FIG. 3 is a timing chart for illustrating a start-up operation in one embodiment.

Next, with reference to FIG. 2, FIG. 3, FIG. 4A, FIG. 4B, FIG. 4C, FIG. 4D, and FIG. 4E, voltage control performed at the time of a start-up operation when starting the image forming operation in this embodiment is described. FIG. 3 is a timing chart for illustrating operation timings and operation states of each of the main motor M, the charging power source E1, the development power source E2, and the transfer power source E3 at the time of the start-up operation in this embodiment. Moreover, FIGS. 4A to 4E are schematic views for illustrating a positional relationship of areas on the photosensitive drum 1 at the time of the start-up operation in this embodiment.

In this embodiment, a control unit (controller) 110 (FIG. 1), which is provided to the image forming apparatus 100 and serves as a control unit, collectively controls operations of components of the image forming apparatus 100 including the main motor M, the charging power source E1, the development power source E2, and the transfer power source E3. The control unit 110 performs sequence control for the operations of the components of the image forming apparatus 100 in accordance with a program stored in a memory (storage portion) serving as a storage unit, which is provided in the control unit 110 or is connected to the control unit 110. Moreover, in this embodiment, the charging power source E1, the development power source E2, and the transfer power source E3 each output the voltage under constant-voltage control. However, the present disclosure is not limited to this configuration. The charging power source E1, the development power source E2, and the transfer power source E3 may output the voltage under constant-current control.

Figure 4A:
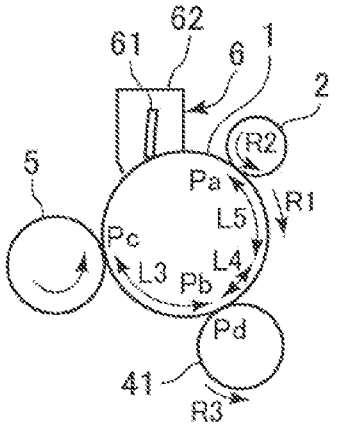
FIG. 4A, FIG. 4B, FIG. 4C, FIG. 4D, and FIG. 4E are schematic views for illustrating a positional relationship of areas on the photosensitive drum in one embodiment.

A timing (A) in FIG. 3 is a timing at which a start instruction for the image forming operation is input to the control unit 110, and the control unit 110 starts the start-up operation substantially at the same time as the timing (A). FIG. 4A is an illustration of a positional relationship of areas on the photosensitive drum 1 at the timing (A). The control unit 110 starts driving the main motor M substantially at the same time as the timing (A). When the main motor M is driven, the photosensitive drum 1, the charging roller 2, and the developing roller 41 are driven to rotate, and the transfer roller 5 follows the rotation of the photosensitive drum 1 to rotate. Moreover, substantially at the same time as the timing (A), the control unit 110 starts application of the same charging voltage (−1,100 V in this embodiment) as the voltage given at the time of image formation (at the time of charging) to the charging roller 2. Moreover, substantially at the same time as the timing (A), the control unit 110 starts application of a first voltage Vt11 (−800 V in this embodiment) having the polarity (the same polarity as the normal charging polarity of the toner) opposite to the polarity given at the time of image formation (at the time of transfer) to the transfer roller 5. The first voltage Vt11 is set to such a voltage having an absolute value equal to or larger than a discharge threshold with respect to a surface potential of the photosensitive drum 1 which passes through the transfer position Pc at the time of the application of the first voltage Vt11. At this time, the surface potential of the photosensitive drum 1 is substantially 0 V that is given in the initial state. Moreover, in this embodiment, the discharge threshold with respect to the surface potential (0 V) of the photosensitive drum 1 at the transfer position Pc is about 600 V. Therefore, after the timing (A), due to the application of the first voltage Vt11 (−800 V) described above, the discharge on the negative polarity side occurs at the transfer position Pc. Moreover, at the time of starting the start-up operation (timing (A)), in an area L3 between the development position Pb and the transfer position Pc on the photosensitive drum 1 in the rotation direction of the photosensitive drum 1, a small amount of toner having moved from the developing roller 41 at the time of terminating the previous image forming operation is present. Most of such toner scarcely has a charge. Thus, with regard to the above-mentioned toner that adheres to the area L3 on the photosensitive drum 1, the above-mentioned discharge at the transfer position Pc gives a charge having the negative polarity (normal charging polarity) to the toner so that the adhesion to the transfer roller 5 is suppressed, thereby allowing the toner to pass through the transfer position Pc. Then, the toner having passed through the transfer position Pc is collected into the cleaning container 62 by the cleaning blade 61. In this embodiment, the area L3 on the photosensitive drum 1 is about 20 mm. Moreover, in the viewpoint that application of the voltage higher than required may cause degradation of the transfer roller 5 or the photosensitive drum 1, it is preferred that the first voltage Vt11 have an absolute value equal to or less than the transfer voltage given at the time of image formation (at the time of transfer) (for example, equal to or less than 2,000 V).

Figure 4B:
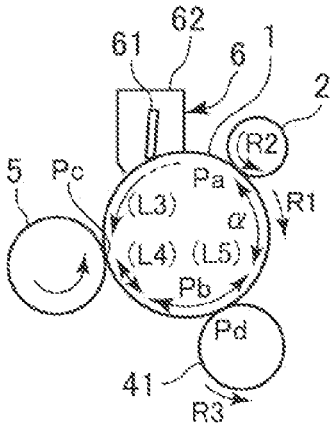

A timing (B) in FIG. 3 is a timing at which the surface of the photosensitive drum 1 has moved by a distance corresponding to the area L3 on the photosensitive drum 1 from the timing (A). FIG. 4B is an illustration of a positional relationship of areas on the photosensitive drum 1 at the timing (B). During the period in which the surface of the photosensitive drum 1 moves by the distance corresponding to the area L3 on the photosensitive drum 1 from the timing (A), the above-mentioned application of the first voltage Vt11 that causes the discharge of the negative polarity at the transfer position Pc is performed. An area α on the photosensitive drum 1 in FIG. 4B represents a charged area on the photosensitive drum 1 in the rotation direction of the photosensitive drum 1.

Meanwhile, the toner which is present in an area L1 (FIG. 2) between the regulating position Pe and the supply position Pd on the developing roller 41 in the rotation direction of the developing roller 41 at the time of starting the start-up operation (timing (A)) arrives at the supply position Pd without being subjected to the frictional charging action of the developing blade 42. Moreover, during a period in which the surface of the developing roller 41 moves by a distance corresponding to the area L1 on the developing roller 41 from the timing (A), the photosensitive drum 1 and the developing roller 41 rotate with a circumferential speed difference therebetween while the surface potential of the photosensitive drum 1 that arrives at the development position Pb is kept at approximately 0 V and the developing voltage remains being in an OFF state. Therefore, at the time of the start-up operation, the phenomenon in which the toner scarcely having a charge in the area L1 on the developing roller 41 moves to the photosensitive drum 1 due to friction contact with the photosensitive drum 1 at the development position Pb (hereinafter referred to as "start-up fog") occurs. Here, an area L4 on the photosensitive drum 1 in the rotation direction of the photosensitive drum 1 corresponds to an area on the photosensitive drum 1 which passes through the development position Pb while the area L1 on the developing roller 41 passes through the supply position Pd. The developing roller 41 rotates at a speed which is 1.2 times as fast as the photosensitive drum 1, and hence the area L1 on the developing roller 41 is 1.2 times as large as the area L4 on the photosensitive drum 1. In this embodiment, the area L1 on the developing roller 41 is about 10 mm, and the area L4 on the photosensitive drum 1 is about 8.3 mm. Also with regard to the toner having moved from the area L1 on the developing roller 41 to the area L4 on the photosensitive drum 1, similarly to the above-mentioned toner in the area L3, the above-mentioned discharge at the transfer position Pc gives a charge having the negative polarity to the toner so that the adhesion to the transfer roller 5 is suppressed, thereby allowing the toner to pass through the transfer position Pc.

Figure 4C:
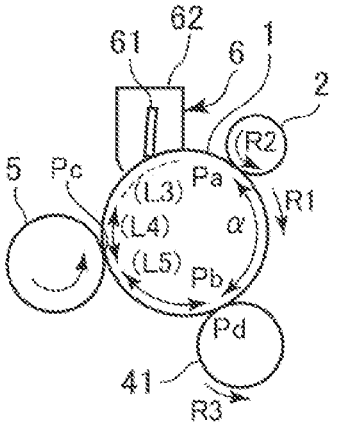
Figure 5:
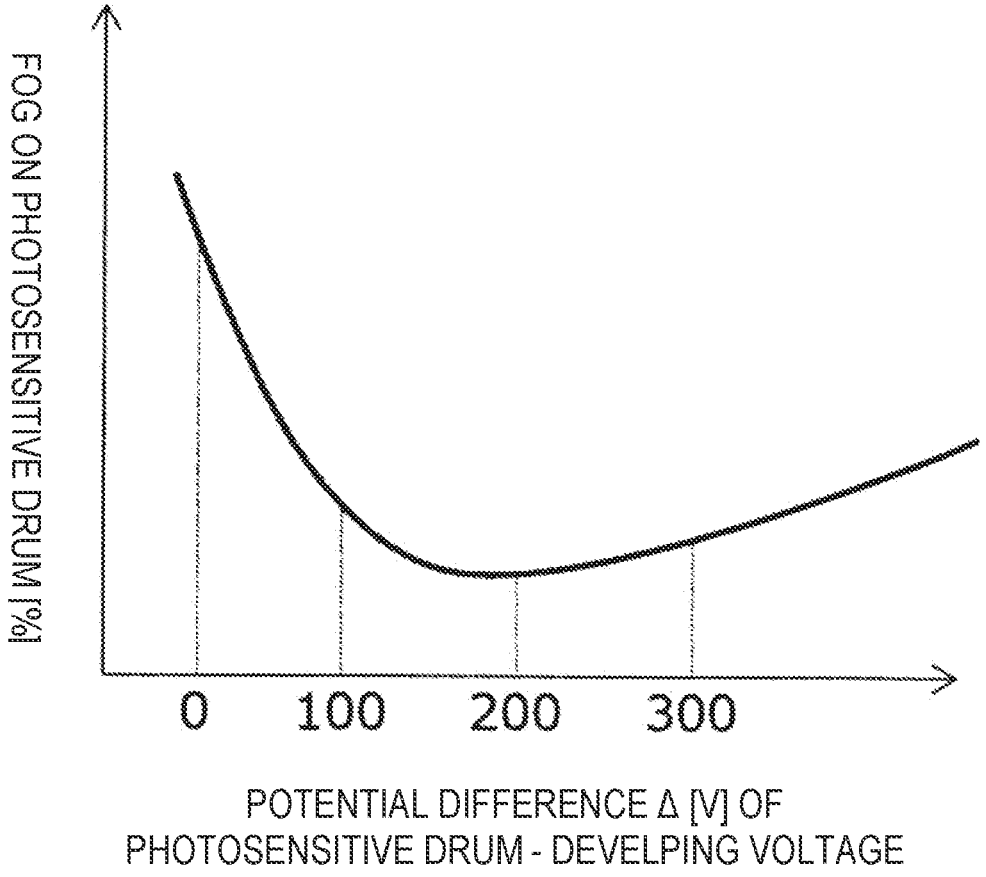
FIG. 5 is a graph for showing a fog curve on the photosensitive drum.

A timing (C) in FIG. 3 is a timing at which the surface of the photosensitive drum 1 has moved by a distance corresponding to the sum of the area L4 and an area L5 on the photosensitive drum 1 from the timing (A). The area L5 on the photosensitive drum 1 at the timing (A) is an area which is obtained by excluding the above-mentioned area L4 on the photosensitive drum 1 from the area between the charging position Pa and the development position Pb in the rotation direction of the photosensitive drum 1 at the same timing. FIG. 4C is an illustration of a positional relationship of areas on the photosensitive drum 1 at the timing (C). The area α on the photosensitive drum 1 charged at the charging position Pa arrives at the development position Pb on the photosensitive drum 1 substantially at the same time as the timing (C). In this embodiment, the surface potential of the charged area α on the photosensitive drum 1 is about −500 V. Then, substantially at the same time as the timing (C), the control unit 110 starts application of the same developing voltage (−300 V in this embodiment) as that given at the time of image formation (at the time of development) to the developing roller 41. As a result, a potential difference Δ of the surface potential (−500 V) of the photosensitive drum 1 and the developing voltage (−300 V) at the development position Pb becomes 200 V. Therefore, movement of the toner having the negative polarity from the developing roller 41 to the photosensitive drum 1 (so-called fog phenomenon) after the timing (C) is suppressed. This toner has been charged to the negative polarity by the developing blade 42. FIG. 5 is a graph (fog curve) for showing a relationship between the potential difference Δ of the surface potential of the photosensitive drum 1 and the developing voltage and the amount of toner that adheres to the photosensitive drum 1 due to the fog phenomenon (indicated by optical density (%)). In this embodiment, in order to suppress the fog, it is preferred that the potential difference Δ of the surface potential of the photosensitive drum 1 and the developing voltage be about 200 V.

Figure 4D:
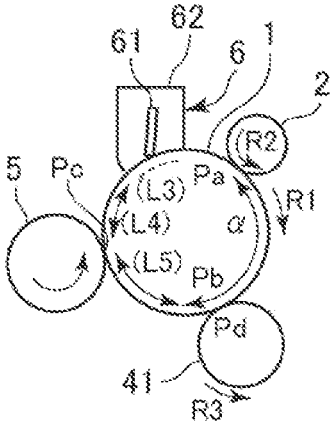

A timing (D) in FIG. 3 is a timing at which the surface of the photosensitive drum 1 has moved by a distance corresponding to the area L4 on the photosensitive drum 1 from the timing (B) (that is, a timing at which the surface of the developing roller 41 has moved by a distance corresponding to the area L1 on the developing roller 41). FIG. 4D is an illustration of a positional relationship of areas on the photosensitive drum 1 at the timing (D). Then, substantially at the same time as the timing (D), the control unit 110 changes the voltage applied to the transfer roller 5 from the above-mentioned first voltage Vt11 (−800 V in this embodiment) to a second voltage Vt12 (−300 V in this embodiment). The second voltage Vt12 is a voltage having an absolute value less than the discharge threshold with respect to the surface potential of the photosensitive drum 1 that passes through the transfer position Pc at the time of application of the second voltage Vt12. At this time, the charged area α on the photosensitive drum 1 has arrived at the development position Pb but has not arrived at the transfer position Pc, and the surface potential of the photosensitive drum 1 at the transfer position Pc is kept at approximately 0 V. Moreover, as mentioned above, the discharge threshold with respect to the surface potential (0 V) of the photosensitive drum 1 at the transfer position Pc is about 600 V. Therefore, after the timing (D), through the application of the above-mentioned second voltage Vt12 (−300 V), the discharge does not occur at the transfer position Pc, and an electric field on the negative polarity side with respect to the photosensitive drum 1 is formed from the transfer roller 5. Moreover, the toner that arrives at the transfer position Pc after the timing (D) is the toner that has been present in the area L2 located more on the upstream side than the regulating position Pe (more on the downstream side than the supply position Pd) on the developing roller 41 in the rotation direction of the developing roller 41 at the time of starting the start-up operation (timing (A)). This toner is frictionally charged by the developing blade 42 along with the rotation of the developing roller 41, and thus has a charge having the negative polarity being the normal charging polarity of the toner. Thus, the toner on the photosensitive drum 1 with the charge having the negative polarity passes through the transfer position Pc while adhering to the photosensitive drum 1 due to the electric field generated between the transfer roller 5 and the photosensitive drum 1 at the transfer position Pc. Then, the toner having passed through the transfer position Pc is collected into the cleaning container 62 by the cleaning blade 61. In view of forming an electric field capable of sufficiently suppressing the movement of the toner having the negative polarity on the photosensitive drum 1 to the transfer roller 5, it is preferred that the second voltage Vt12 have an absolute value equal to or larger than 50 V.

Here, consideration is made of a case in which the voltage applied to the transfer roller 5 at the timing (D) is kept at the first voltage Vt11 (−800 V). In this case, when the toner on the photosensitive drum 1 with the charge having the negative polarity passes through the transfer position Pc, the voltage having an absolute value equal to or larger than the discharge threshold is applied to the transfer roller 5. In this case, the toner on the photosensitive drum 1 with the charge having the negative polarity has an excessively strong charge on the negative polarity side, with the result that an electrostatic adhesion force with respect to the photosensitive drum 1 increases. As a result, the toner may pass through the cleaning blade 61 or cause degradation of an edge of the cleaning blade 61 which is in abutment against the photosensitive drum 1. Then, at the time of subsequent image formation, image defects such as vertical black streaks caused by poor cleaning of the photosensitive drum 1 may occur.

In order to suppress the start-up fog, it is conceivable to separate the developing roller away from the photosensitive drum at the time of the start-up operation. Moreover, in order to suppress adhesion of the toner having moved onto the photosensitive drum due to the start-up fog to the transfer roller, it is conceivable to separate the transfer roller away from the photosensitive drum at the time of the start-up operation. However, such a configuration causes increases in complexity, size, and cost of the image forming apparatus.

Figure 4E:
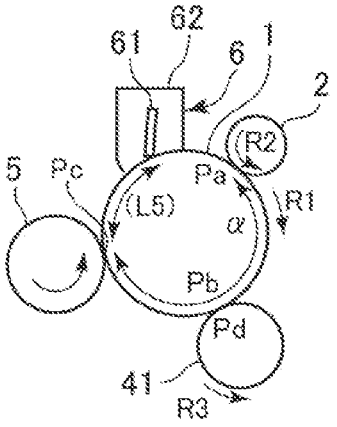

A timing (E) in FIG. 3 is a timing at which the surface of the photosensitive drum 1 has moved by a distance corresponding to the area L5 on the photosensitive drum 1 from the timing (D). In this embodiment, the area L5 on the photosensitive drum 1 is about 16 mm. FIG. 4E is an illustration of a positional relationship of areas on the photosensitive drum 1 at the timing (E). The charged area α on the photosensitive drum 1 arrives at the transfer position Pc substantially at the same time as the timing (E). Then, substantially at the same time as the timing (E), the control unit 110 changes the voltage applied to the transfer roller 5 from the above-mentioned second voltage Vt12 (−300 V) to a transfer voltage Vt01 (+800 V in this embodiment) having the polarity opposite to the normal charging polarity of the toner to be ready for the image formation. The transfer voltage Vt01 may be the same voltage as that given at the time of image formation (at the time of transfer). Alternatively, the transfer voltage Vt01 may be the same as the voltage corresponding to the voltage applied when a non-image formation area (for example, a portion between sheets) other than an image formation area on the photosensitive drum 1 in the rotation direction of the photosensitive drum 1 passes through the transfer position Pc. This voltage may be a voltage having the same polarity as that of the transfer voltage given at the time of image formation (at the time of transfer) and having an absolute value less than that of the transfer voltage given at the time of image formation (at the time of transfer). The transfer voltage given at the time of image formation (at the time of transfer) is a transfer voltage given when the image formation area on the photosensitive drum 1 in the rotation direction of the photosensitive drum 1 passes through the transfer position Pc. Moreover, the image formation area on the photosensitive drum 1 is an area in which the toner image may be formed.

After that, the control unit 110 terminates the start-up operation substantially at the same time as the timing (F) at which the fixing device 7 is ready, and then starts an image forming operation such as formation of an electrostatic latent image by the exposure device 3.

As described above, the image forming apparatus 100 according to this embodiment includes the control unit 110 which is configured to control the transfer power source E3. At a time of the start-up operation at the time of starting the image forming operation, on the surface of the photosensitive member, a first position coincides with the charging position, a second position coincides the development position, and a third position coincides with the transfer position, and on the surface of the development member, a fourth position coincides with the regulating position, and a fifth position coincides with the supply position. During the period in which the area on the photosensitive drum 1 located between the first position and the third position in the rotation direction of the photosensitive drum 1 passes through the transfer position Pc, the control unit 110 performs the control of applying the first voltage having the same polarity as the normal charging polarity of the toner to the transfer roller 5 through use of the transfer power source E3 and, at a predetermined timing after the first voltage is applied, changing the voltage applied to the transfer roller 5 from the first voltage to the second voltage having an absolute value less than that of the first voltage. In this embodiment, the control unit 110 controls the predetermined timing such that the predetermined timing matches with the timing at which the second position on the photosensitive drum 1 first arrives at the transfer position Pc after starting the start-up operation when the fourth position on the developing roller 41 first arrives at the supply position Pd after starting the start-up operation. In this embodiment, during the period in which the area on the photosensitive drum 1 located between the first position and the second position in the rotation direction of the photosensitive drum 1 passes through the development position Pb, the developing roller 41 is in abutment against the photosensitive drum 1. Moreover, in this embodiment, during the period in which the area on the photosensitive drum 1 located between the first position and the third position in the rotation direction of the photosensitive drum 1 passes through the transfer position Pc, the transfer roller 5 is in abutment against the photosensitive drum 1.

5. Actions and Effects of this Embodiment

As described above, in this embodiment, in the start-up operation, during the period in which the uncharged area of the surface of the photosensitive drum 1 in the rotation direction of the photosensitive drum 1 passes through the transfer position Pc, the voltage having the same polarity as the normal charging polarity of the toner is applied to the transfer roller 5. Moreover, during that period, the voltage applied to the transfer roller 5 is changed from the voltage having an absolute value equal to or larger than the discharge threshold with respect to the surface potential of the photosensitive drum 1 to the voltage having an absolute value less than the discharge threshold with respect to the surface potential of the photosensitive drum 1. Moreover, the timing of changing the voltage is matched with the timing at which the second position on the photosensitive drum 1 first arrives at the transfer position Pc after the starting the start-up operation when the fourth position on the developing roller 41 first arrives at the supply position Pd after starting the start-up operation. Here, matching the timing typically means setting the timing substantially at the same time. However, there may be, for example, a deviation to the extent of an error within the range in which the above-mentioned effect can be efficiently achieved (for example, a time lag corresponding to the range of about ±3 mm in the movement distance of the surface of the photosensitive drum 1). In this embodiment, in the start-up operation, during the period in which the uncharged area of the surface of the photosensitive drum 1 in the rotation direction of the photosensitive drum 1 passes through the development position Pb, the voltage is not applied to the developing roller 41.

In such a manner, the adhesion of the uncharged toner having moved onto the photosensitive drum 1 to the transfer roller 5 can be suppressed, and the increase in the electrostatic adhesion force of the toner having a charge on the photosensitive drum 1 can be suppressed. Thus, the image defects such as the dirt on the back of the recording material P and the vertical black streaks caused by poor cleaning can be suppressed. Moreover, the degradation of the cleaning blade 61 is suppressed, thereby being capable of achieving a longer lifetime of the image forming apparatus 100.

In this embodiment, the ON timing of the driving of the main motor M is set to the same timing as the ON timing of the charging voltage and the ON timing of the first voltage Vt11. However, the timings may be suitably changed depending on, for example, a response speed of the main motor M or the start-up time of the charging voltage or the transfer voltage. For example, the charging voltage or the transfer voltage may be turned ON at the timing at which the main motor M assuredly starts driving in consideration of the response speed from the ON timing of the driving of the main motor M.

Moreover, in this embodiment, in the start-up operation, the voltage is not applied to the developing roller 41 during the period in which the uncharged area of the surface of the photosensitive drum 1 passes through the development position Pb. However, the voltage having the same polarity as the normal charging polarity of the toner may be applied to the developing roller 41 during this period. Also in this case, through the control of the voltage applied to the transfer roller 5 at the time of the start-up operation similarly to this embodiment, the same effect as that of this embodiment can be obtained. That is, during the period in which the area on the photosensitive drum 1 located more on the downstream side than the charging position Pa and more on the upstream side than the development position Pb in the rotation direction of the photosensitive drum 1 at the time of starting the start-up operation, the control unit 110 may perform the control of not applying the voltage to the developing roller 41 through use of the development power source E2 or applying the voltage having the same polarity as the normal charging polarity of the toner.

Second Embodiment

Next, another embodiment of the present disclosure is described. The basic configuration and operation of the image forming apparatus according to this embodiment are the same as those of the image forming apparatus according to the first embodiment. Thus, elements of the image forming apparatus according to this embodiment having functions or configurations which are the same as or correspond to those of the image forming apparatus according to the first embodiment are denoted by the same reference symbols as those of the image forming apparatus according to the first embodiment, and detailed description thereof is omitted.

1. Image Forming Apparatus

The image forming apparatus 100 according to this embodiment uses a cleaner-less method, and does not include a special cleaning device for removing the transfer residual toner from the photosensitive drum 1. In the image forming apparatus 100 according to this embodiment, the transfer residual toner is collected through "cleaning simultaneous with developing" by the developing roller 41 of the developing device 4. That is, in the image forming apparatus 100 according to this embodiment, the developing roller 41 of the developing device 4 has a function to supply toner to an electrostatic image on the photosensitive drum 1 at the development position Pb and a function to collect transfer residual toner at the development position Pb.

2. Cleaning Simultaneous with Developing

Figure 6:
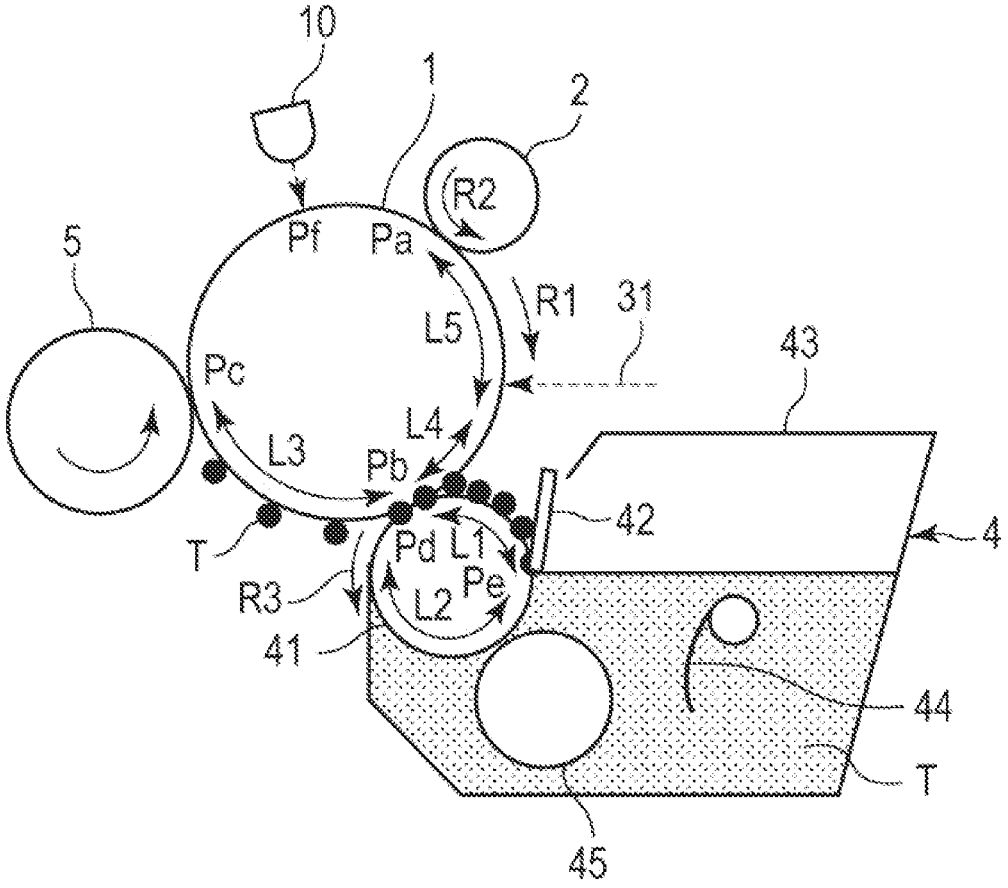
FIG. 6 is a schematic sectional view for illustrating the surroundings of the photosensitive drum in another embodiment.

The cleaning simultaneous with developing is further described with reference to FIG. 6. FIG. 6 is a schematic sectional view for illustrating the surroundings of the photosensitive drum 1 including the developing device 4 in this embodiment (cross section substantially orthogonal to the rotation axis direction of the photosensitive drum 1). The image forming apparatus 100 according to this embodiment includes a pre-exposure device 10. The pre-exposure device 10 is provided more on the downstream side than the transfer roller 5 and more on the upstream side than the charging roller 2 in the rotation direction of the photosensitive drum 1, and serves as a charge removal unit configured to subject the surface of the photosensitive drum 1 to charge-removal processing (optical charge-removal processing in this embodiment). The charge-removal processing includes not only the processing of removing all of the charge to set the potential to 0 V but also the processing of removing at least part of the charge.

In order to cause stable discharge at the charging position Pa, the pre-exposure device 10 optically removes the surface potential of the photosensitive drum 1 before entry to the charging position Pa. A position at which the exposure (charge removal) is performed by the pre-exposure device 10 is a charge-removal position Pf. The charge-removal position Pf is located more on the downstream side than the transfer position Pc and more on the upstream side than the charging position Pa in the rotation direction of the photosensitive drum 1. Toner being charged to the polarity opposite to the normal charging polarity and toner being charged to the normal charging polarity but not having a sufficient charge coexist in the transfer residual toner. These toners can be charged to the normal charging polarity again by removing the charge on the photosensitive drum 1 through use of the pre-exposure device 10 after the transfer and causing uniform discharge at the time of charging the photosensitive drum 1.

The toner having been charged to the negative polarity at the charging position Pa is sent to the development position Pb along with the rotation of the photosensitive drum 1. At a non-image portion (non-exposure portion), the toner having been sent to the development position Pb is moved to the developing roller 41 due to a potential difference of a dark-portion potential (Vd) of the surface of the photosensitive drum 1 and a developing voltage (Vdc), and is then scraped off by the supply roller 45 and collected into the developing container 43. Meanwhile, at an image portion (exposure portion), the toner having been sent to the development position Pb is not moved to the developing roller 41 due to a potential difference of a light-portion potential (V1) of the surface of the photosensitive drum 1 and the developing voltage (Vdc). Then, the toner is sent as toner for the image portion to the transfer position Pc along with the rotation of the photosensitive drum 1 and transferred to the recording material P.

As described above, in this embodiment, the developing device 4 collects the toner on the photosensitive drum 1 having passed through the transfer position Pc. Moreover, in this embodiment, the image forming apparatus 100 includes the pre-exposure device 10 serving as a charge removal unit configured to remove at least part of the charge on the surface of the photosensitive drum 1 at a position more on the downstream side than the transfer position Pc and more on the upstream side than the charging position Pa in the rotation direction of the photosensitive drum 1.

3. Voltage Control at the Time of Start-Up Operation

Next, voltage control performed at the time of the start-up operation when starting the image forming operation in this embodiment is described. The voltage control performed at the time of the start-up operation in this embodiment is the same as the voltage control performed at the time of the start-up operation in the first embodiment except for the operation of the pre-exposure device 10, and hence the overlapping description is omitted.

Referring to FIG. 3, in this embodiment, substantially at the same time as the timing (A), the control unit 110 starts turning on the pre-exposure device 10. This is for the purpose of charging the toner having no charge, which is ejected onto the photosensitive drum 1 from the transfer roller 5 after the transfer voltage is turned ON, to the negative polarity through the discharge at the charging position Pa and collecting the charged toner into the developing roller 41. It is only required that the pre-exposure device 10 be turned on before the position on the photosensitive drum 1 located at the transfer position Pc at the time of turning ON the transfer voltage arrives at the charge-removal position Pf. After that, the pre-exposure device 10 is kept in the ON state continuously until the image forming operation is terminated, and then is brought into the OFF state at the time of terminating the image forming operation.

4. Actions and Effects of this Embodiment

In the image forming apparatus 100 using the cleaner-less method as in this embodiment, when the electrostatic adhesion force of the toner on the photosensitive drum 1 increases, the toner does not move to the developing roller 41 at the development position Pb, which may cause defects in collection of the transfer residual toner by the developing device 4. Further, the toner which remains on the surface of the photosensitive drum 1 may be transferred to the recording material P at the transfer position Pc, which may cause "ghost" being the phenomenon in which the toner appears as an image.

In contrast, according to this embodiment, similarly to the first embodiment, the adhesion of the uncharged toner having moved onto the photosensitive drum 1 to the transfer roller 5 can be suppressed, and the increase in the electrostatic adhesion force of the toner having a charge on the photosensitive drum 1 can be suppressed. Thus, according to this embodiment, image defects such as the dirt on the back of the recording material P and the ghost caused by defects in collection of the transfer residual toner by the developing device 4 can be suppressed.

Third Embodiment

Next, another embodiment of the present disclosure is described. The basic configuration and operation of the image forming apparatus according to this embodiment are the same as those of the image forming apparatus according to the first embodiment. Thus, elements of the image forming apparatus according to this embodiment having functions or configurations which are the same as or correspond to those of the image forming apparatus according to the first embodiment are denoted by the same reference symbols as those of the image forming apparatus according to the first embodiment, and detailed description thereof is omitted.

1. Image Forming Apparatus

In this embodiment, the development power source E2 is capable of applying a direct-current voltage having the negative polarity and a direct-current voltage having the positive polarity to the developing roller 41. Further, in this embodiment, at the time of the start-up operation, the development power source E2 applies the direct-current voltage having the positive polarity (the polarity opposite to the normal charging polarity of the toner) to the developing roller 41.

2. Voltage Control at the Time of Start-Up Operation

Figure 7:
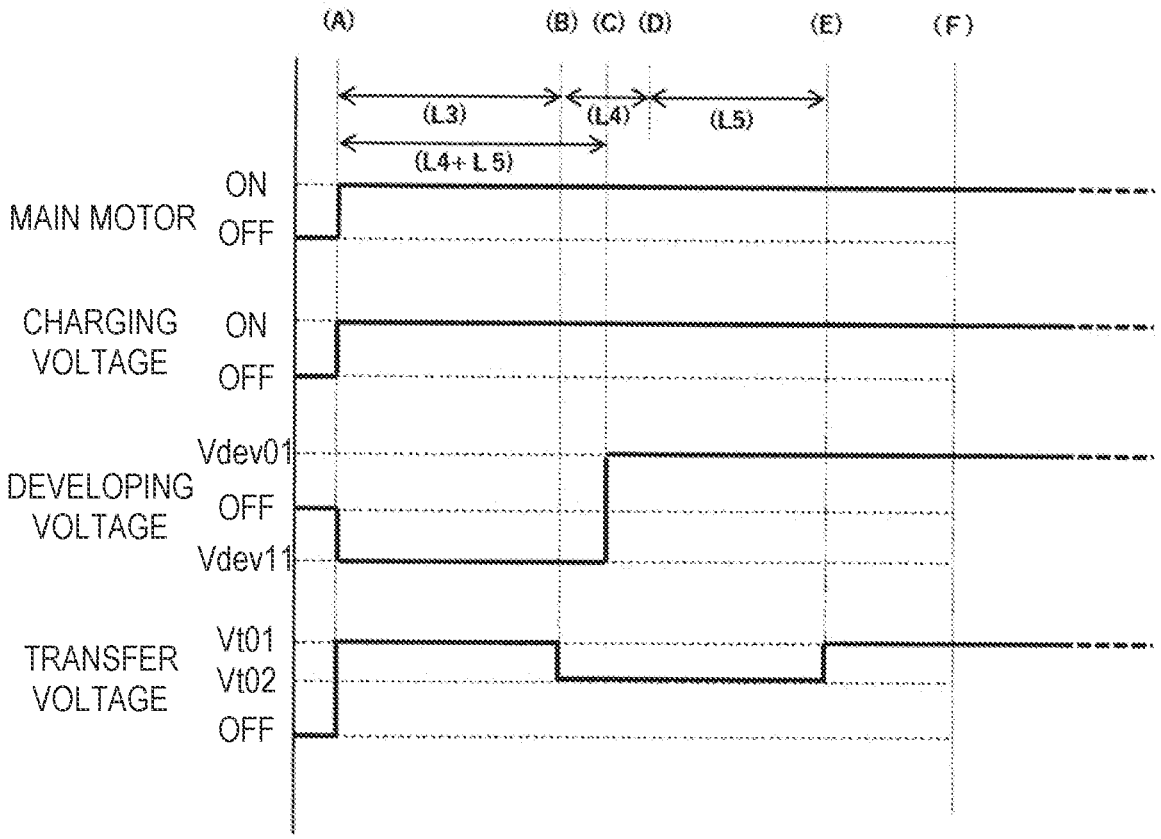
FIG. 7 is a timing chart for illustrating a start-up operation in another embodiment.

Next, with reference to FIG. 7, voltage control performed at the time of a start-up operation when starting the image forming operation in this embodiment is described. FIG. 7 is a timing chart for illustrating operation timings and operation states of each of the main motor M, the charging power source E1, the development power source E2, and the transfer power source E3 at the time of the start-up operation in this embodiment.

A timing (A) in FIG. 7 is a timing at which a start instruction for the image forming operation is input to the control unit 110, and the control unit 110 starts the start-up operation substantially at the same time as the timing (A). FIG. 4A is an illustration of a positional relationship of areas on the photosensitive drum 1 at the timing (A). The control unit 110 starts driving the main motor M substantially at the same time as the timing (A). When the main motor M is driven, the photosensitive drum 1, the charging roller 2, and the developing roller 41 are driven to rotate, and the transfer roller 5 follows the rotation of the photosensitive drum 1 to rotate. Moreover, substantially at the same time as the timing (A), the control unit 110 starts application of the same charging voltage (−1,100 V in this embodiment) as the voltage given at the time of image formation (at the time of charging) to the charging roller 2.

Moreover, in this embodiment, substantially at the same time as the timing (A), application of a start-up developing voltage Vdev11 (+100 V in this embodiment), which has the polarity opposite to the polarity given at the time of image formation (at the time of development) (the polarity opposite to the normal charging polarity of the toner), to the developing roller 41 is started. At this time, in the area L1 (FIG. 2) on the developing roller 41, toner scarcely having a charge due to the absence of the frictional charging action of the developing blade 42 as well as toner having both positive and negative polarities are present. Through the application of the start-up developing voltage Vdev11 (+100 V) to the developing roller 41, the movement of the toner having the negative polarity on the developing roller 41 to the photosensitive drum 1 can be suppressed. Here, in this embodiment, the start-up developing voltage Vdev11 is set to +100 V. However, it is only required that an electric field capable of sufficiently suppressing the movement of the toner having the negative polarity on the developing roller 41 to the photosensitive drum 1 can be formed. In view of this, it is preferred that the start-up developing voltage Vdev11 be equal to or more than +50 V (have an absolute value equal to or larger than 50 V). Moreover, in the viewpoint that application of the voltage higher than required may cause, for example, degradation of the developing roller 41, the photosensitive drum 1, or the toner, it is preferred that the start-up developing voltage Vdev11 have an absolute value equal to or less than an absolute value of the developing voltage given at the time of image formation (at the time of development) (for example, equal to or less than 400 V).

Moreover, in this embodiment, substantially at the same time as the timing (A), the control unit 110 starts application of a first voltage Vt01 (+800 V in this embodiment) having the same polarity (the polarity opposite to the normal charging polarity of the toner) as the polarity given at the time the image formation (at the time of transfer) to the transfer roller 5. The first voltage Vt01 is set to such a voltage having an absolute value equal to or larger than a discharge threshold with respect to a surface potential of the photosensitive drum 1 which passes through the transfer position Pc at the time of the application of the first voltage Vt01. At this time, the surface potential of the photosensitive drum 1 is substantially 0 V that is given in the initial state. Moreover, in this embodiment, the discharge threshold with respect to the surface potential (0 V) of the photosensitive drum 1 at the transfer position Pc is about 600 V. Therefore, after the timing (A), due to the application of the first voltage Vt01 (+800 V) described above, the discharge on the positive polarity side occurs at the transfer position Pc. Moreover, at the time of starting the start-up operation (timing (A)), in the area L3 (FIG. 4) between the development position Pb and the transfer position Pc on the photosensitive drum 1 in the rotation direction of the photosensitive drum 1, even a small amount toner having moved from the developing roller 41 at the time of terminating the previous image forming operation is present. Most of such toner scarcely has a charge. Thus, with regard to the above-mentioned toner that adheres to the area L3 on the photosensitive drum 1, the above-mentioned discharge at the transfer position Pc gives a charge having the positive polarity (the polarity opposite to the normal charging polarity) to the toner so that the adhesion to the transfer roller 5 is suppressed, thereby allowing the toner to pass through the transfer position Pc. Then, the toner having passed through the transfer position Pc is collected into the cleaning container 62 by the cleaning blade 61. Moreover, in the viewpoint that application of the voltage higher than required may cause degradation of the transfer roller 5 or the photosensitive drum 1, it is preferred that the first voltage Vt01 have an absolute value equal to or less than the transfer voltage given at the time of image formation (at the time of transfer) (for example, equal to or less than 2,000 V).

A timing (B) in FIG. 7 is a timing at which the surface of the photosensitive drum 1 has moved by a distance corresponding to the area L3 on the photosensitive drum 1 from the timing (A). FIG. 4B is an illustration of a positional relationship of areas on the photosensitive drum 1 at the timing (B). During the period in which the surface of the photosensitive drum 1 moves by the distance corresponding to the area L3 on the photosensitive drum 1 from the timing (A), the above-mentioned application of the first voltage Vt01 that causes the discharge of the positive polarity at the transfer position Pc is performed. Then, in this embodiment, substantially at the same time as the timing (B), the control unit 110 changes the voltage applied to the transfer roller 5 from the above-mentioned first voltage Vt01 (+800 V in this embodiment) to a second voltage Vt02 (+300 V in this embodiment). The second voltage Vt02 is a voltage having an absolute value less than the discharge threshold with respect to the surface potential of the photosensitive drum 1 that passes through the transfer position Pc at the time of application of the second voltage Vt02.

That is, similarly to the first embodiment, the toner which is present in the area L1 on the developing roller 41 at the time of starting the start-up operation (timing (A)) arrives at the supply position Pd on the developing roller 41 without being subjected to the frictional charging action of the developing blade 42. Moreover, the surface potential of the photosensitive drum 1 given during this period is approximately 0 V, and the developing voltage Vdev11 is +100 V. Therefore, of the toner on the developing roller 41, substantially only the toner having the positive polarity moves to the area L4 on the photosensitive drum 1 corresponding to the area L1 on the developing roller 41. Thus, after the timing (B) at which the area L4 on the photosensitive drum 1 arrives at the transfer position Pc, substantially only the toner having the positive polarity is present on the photosensitive drum 1. When the application of the above-mentioned first voltage Vt01 is performed while the toner having the positive polarity on the photosensitive drum 1 passes through the transfer position Pc to cause the discharge on the positive polarity side at the transfer position Pc, the toner has an excessively strong charge on the positive polarity side, with the result that the electrostatic adhesion force with respect to the photosensitive drum 1 increases. As a result, the toner may pass through the cleaning blade 61 or cause degradation of an edge of the cleaning blade 61 which is in abutment against the photosensitive drum 1. Then, at the time of subsequent image formation, image defects such as vertical black streaks caused by poor cleaning of the photosensitive drum 1 may occur.

Therefore, in this embodiment, after the timing (B), application of the second voltage Vt02 (+300 V) is performed, thereby forming an electric field on the positive polarity side with respect to the photosensitive drum 1 from the transfer roller 5 at the transfer position Pc. As a result, the adhesion of the toner having the positive polarity on the photosensitive drum 1 to the transfer roller 5 is suppressed, thereby allowing the toner to pass through the transfer position Pc. In view of forming the electric field capable of sufficiently suppressing the movement of the toner having the positive polarity on the photosensitive drum 1 to the transfer roller 5, it is preferred that the second voltage Vt02 have an absolute value equal to or larger than 50 V.

A timing (C) in FIG. 7 is a timing at which the surface of the photosensitive drum 1 has moved by a distance corresponding to the sum of the area L4 and the area L5 on the photosensitive drum 1 from the timing (A). FIG. 4C is an illustration of a positional relationship of areas on the photosensitive drum 1 at the timing (C). The area α on the photosensitive drum 1 charged at the charging position Pa arrives at the development position Pb on the photosensitive drum 1 substantially at the same time as the timing (C). In this embodiment, the surface potential of the charged area α on the photosensitive drum 1 is about −500 V. Substantially at the same time as the timing (C), the control unit 110 changes the voltage applied to the developing roller 41 from the start-up developing voltage Vdev11 (+100 V in this embodiment) to the developing voltage Vdev01 (−300V in this embodiment) having the same polarity as the normal charging polarity of the toner. The developing voltage Vdev01 may be the same as that given at the time of image formation (at the time of development). As a result, the potential difference Δ of the surface potential (−500 V) on the photosensitive drum 1 at the development position Pb and the developing voltage Vdev01 (−300 V) becomes 200 V. Therefore, movement of the toner from the developing roller 41 to the photosensitive drum 1 (so-called fog phenomenon) after the timing (C) is suppressed. This toner is charged to the negative polarity by the developing blade 42.

A timing (D) in FIG. 7 is a timing at which the surface of the photosensitive drum 1 has moved by a distance corresponding to the area L4 on the photosensitive drum 1 from the timing (B) (that is, a timing at which the surface of the developing roller 41 has moved by a distance corresponding to the area L1 on the developing roller 41). FIG. 4D is an illustration of a positional relationship of areas on the photosensitive drum 1 at the timing (D). The toner on the photosensitive drum 1 which arrives at the transfer position Pc after the timing (B) is the toner having the positive polarity. Therefore, the application of the second voltage Vt02 (+300 V) is continuously performed after the timing (D) to suppress the adhesion of the toner having the positive polarity on the photosensitive drum 1 to the transfer roller 5, thereby allowing the toner to pass through the transfer position Pc.

A timing (E) in FIG. 7 is a timing at which the surface of the photosensitive drum 1 has moved by a distance corresponding to the area L5 on the photosensitive drum 1 from the timing (D). FIG. 4E is an illustration of a positional relationship of areas on the photosensitive drum 1 at the timing (E). The charged area α on the photosensitive drum 1 arrives at the transfer position Pc substantially at the same time as the timing (E). Then, substantially at the same time as the timing (E), the control unit 110 changes the voltage applied to the transfer roller 5 from the above-mentioned second voltage Vt02 (+300 V) to a transfer voltage Vt01 (+800 V in this embodiment) having the polarity opposite to the normal charging polarity of the toner to be ready for the image formation. The transfer voltage Vt01 may be the same voltage as that given at the time of image formation (at the time of transfer). In this embodiment, the transfer voltage Vt01 and the above-mentioned first voltage Vt01 are the same.

After that, the control unit 110 terminates the start-up operation substantially at the same time as the timing (F) at which the fixing device 7 is ready, and then starts an image forming operation such as formation of an electrostatic latent image by the exposure device 3.

As described above, in this embodiment, in the start-up operation when starting the image forming operation, during the period in which the area on the photosensitive drum 1 located more on the downstream side than the charging position Pa and more on the upstream side than the development position Pb in the rotation direction of the photosensitive drum 1 passes through the development position Pb at the time of starting the start-up operation, the control unit 110 performs control of applying the voltage having the polarity opposite to the normal charging polarity of the toner to the developing roller 41 through use of the development power source E2. Moreover, in the start-up operation, during the period in which the area on the photosensitive drum 1 located more on the downstream side than the charging position Pa and more on the upstream side than the transfer position Pc in the rotation direction of the photosensitive drum 1 passes through the transfer position Pc at the time of starting the start-up operation, the control unit 110 performs control of applying the voltage having the polarity opposite to the normal charging polarity of the toner to the transfer roller 5 through use of the transfer power source E3 and changing the voltage from the first voltage to the second voltage having an absolute value less than that of the first voltage at a predetermined timing. In this embodiment, the control unit 110 controls the predetermined timing such that the predetermined timing matches with the timing at which the second position on the photosensitive drum 1 first arrives at the transfer position Pc after starting the start-up operation.

3. Actions and Effects of this Embodiment

As described above, in this embodiment, in the start-up operation, during the period in which the uncharged area of the surface of the photosensitive drum 1 in the rotation direction of the photosensitive drum 1 passes through the development position Pb, the voltage having the polarity opposite to the normal charging polarity of the toner is applied to the developing roller 41. Then, in this embodiment, in the start-up operation, during the period in which the uncharged area on the surface of the photosensitive drum 1 in the rotation direction of the photosensitive drum 1 passes through the transfer position Pc, the voltage having the polarity opposite to the normal charging polarity of the toner is applied to the transfer roller 5. Moreover, during that period, the voltage applied to the transfer roller 5 is changed from the voltage having an absolute value equal to or larger than the discharge threshold with respect to the surface potential of the photosensitive drum 1 to the voltage having an absolute value less than the discharge threshold with respect to the surface potential of the photosensitive drum 1. Moreover, the timing of changing the voltage is matched with the timing at which the second position on the photosensitive drum 1 (at the time of starting application of the developing voltage having the polarity opposite to that given at the time of image formation) first arrives at the transfer position Pc. Here, matching the timing typically means setting the timing substantially at the same time. However, there may be, for example, a deviation to the extent of an error within the range in which the above-mentioned effect can be efficiently achieved (for example, a time lag corresponding to the range of about ±3 mm in the movement distance of the surface of the photosensitive drum 1).

In such a manner, the adhesion of the uncharged toner having moved onto the photosensitive drum 1 to the transfer roller 5 can be suppressed, and the increase in the electrostatic adhesion force of the toner having a charge on the photosensitive drum 1 can be suppressed. Thus, the image defects such as the dirt on the back of the recording material P and the vertical black streaks caused by poor cleaning can be suppressed. Moreover, the degradation of the cleaning blade 61 is suppressed, thereby being capable of achieving a longer lifetime of the image forming apparatus 100.

Also with the image forming apparatus 100 using the cleaner-less method described in the second embodiment, the same effect can be obtained through use of the same voltage control as this embodiment in place of the voltage control described in the second embodiment.

Moreover, in this embodiment, the voltage applied to the transfer roller 5 is changed from the first voltage to the second voltage at the timing (B). However, similarly to the first embodiment, the voltage may be changed at the timing (D). The toner on the photosensitive drum 1 which passes through the transfer position Pc before the timing (D) is the toner which has not been frictionally charged by the developing blade 42 and thus has been relatively weakly charged to the positive polarity, or toner which has moved to the photosensitive drum 1 through friction contact and scarcely has a charge. Therefore, even when the charge is given to the toner through the discharge at the transfer position Pc, the electrostatic adhesion force of the toner is less liable to become excessively strong.

[Others]

The present disclosure is described above by way of specific embodiments. However, the present disclosure is not limited to the embodiments described above.

In the above-mentioned embodiments, the photosensitive member being a drum-type (cylindrical) member is described. However, the photosensitive member may be, for example, a rotatable rotary member (rotary body) in another mode such as an endless belt-like member wound around a plurality of support rollers.

Moreover, in the above-mentioned embodiments, the charging member being a roller-shaped member is described. However, the charging member may be, for example, a rotatable rotary member (rotary body) in another mode such as an endless belt-like member wound around a plurality of support rollers. The same also applies to the development member and the transfer member. When the endless belt-like member is used, for example, one of a plurality of support rollers may be in abutment against the photosensitive member through intermediation of a belt.

Moreover, in the above-mentioned embodiments, the case in which the non-magnetic one-component developer is used as the developer is described. However, the present disclosure is applicable also to a case in which a magnetic one-component developer is used as the developer, and the same effect as that of the above-mentioned embodiments can be obtained.

Figure 8:
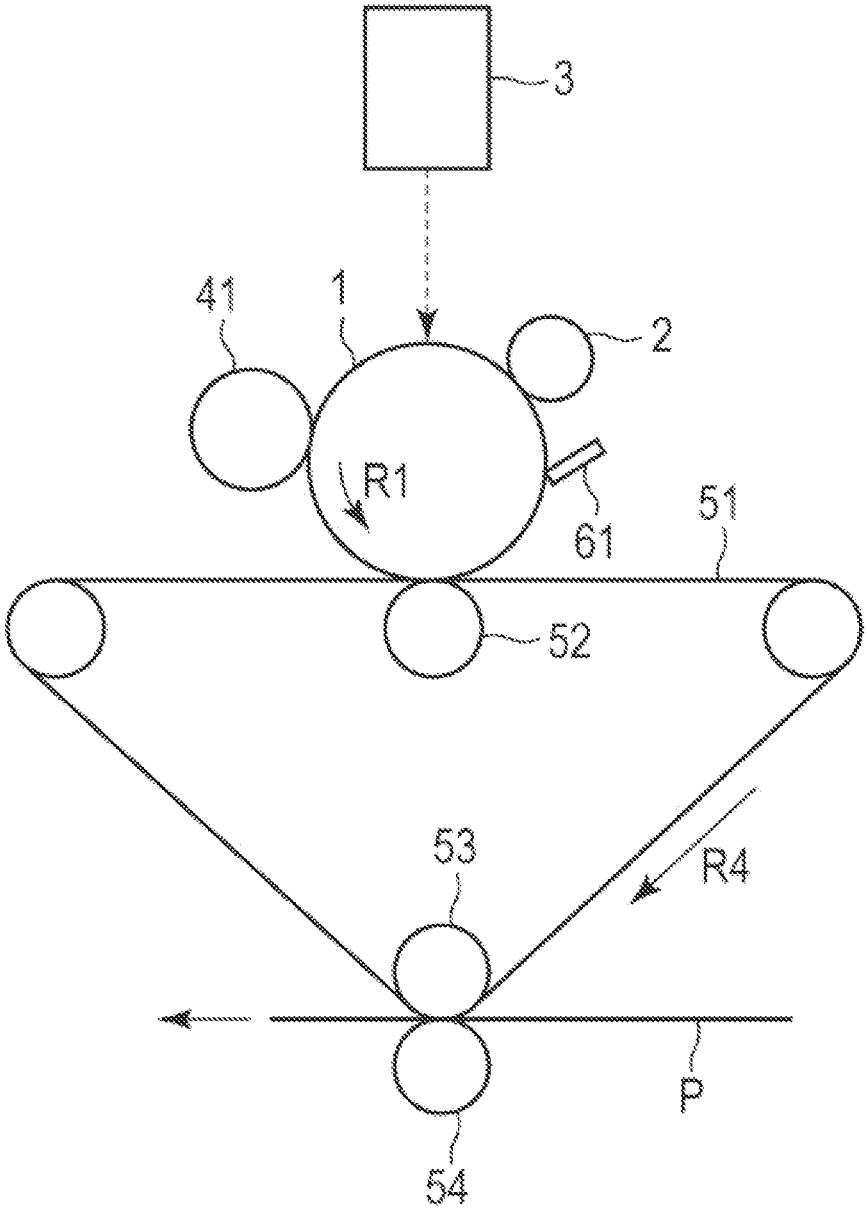
FIG. 8 is an explanatory schematic view for illustrating an image forming apparatus using an intermediate transfer method.

Moreover, in the above-mentioned embodiments, the image forming apparatus has the configuration in which the toner image is directly transferred from the photosensitive member to the recording material. The present disclosure is not limited to this configuration, and is applicable also to an image forming apparatus using an intermediate transfer method. FIG. 8 is a schematic view for illustrating a schematic configuration of the image forming apparatus using the intermediate transfer method. In FIG. 8, elements having functions or configurations which are the same as or correspond to those of the image forming apparatus according to the above-mentioned embodiments are denoted by the same reference symbols. The image forming apparatus 100 using the intermediate transfer method includes, for example, an intermediate transfer belt 51 formed of an endless belt, which is arranged so as to be opposed to the photosensitive drum 1 and serves as an intermediate transfer member. In the image forming apparatus using the intermediate transfer method, the intermediate transfer member serves as the transfer member, which is configured to transfer the toner image on the photosensitive member to a recording material and is in contact with the photosensitive member at the transfer position in the rotation direction of the photosensitive member. The intermediate transfer member is configured to bear and convey a toner image, which has been transferred from the photosensitive member at a contact portion between the photosensitive member and the transfer member, to transfer the toner image to the recording material. The intermediate transfer belt 51 is wound around a plurality of support rollers (tension rollers) and stretched with a predetermined tensile force. The intermediate transfer belt 51 is rotated in an R4 direction of FIG. 8 (circumferentially moved) through rotational driving of a drive roller among the plurality of support rollers. In many cases, on an inner peripheral surface side of the intermediate transfer belt 51, a primary transfer roller 52, which is formed of a roller-shaped member serving as a voltage application member (primary transfer member), is arranged so as to be opposed to the photosensitive drum 1. Moreover, in many cases, on an outer peripheral surface side of the intermediate transfer belt 51, at a position opposed to a secondary transfer inner roller 53 among the plurality of support rollers, a secondary transfer outer roller 54 formed of a roller-shaped member is arranged. The intermediate transfer belt 51 is sandwiched between the secondary transfer inner roller 53 and the secondary transfer outer roller 54. The toner image formed on the photosensitive drum 1 in the same manner as the above-mentioned embodiments is primarily transferred onto the intermediate transfer belt 51 at the contact portion between the photosensitive drum 1 and the intermediate transfer belt 51 by an action of the primary transfer roller 52. At the time of the primary transfer, a primary transfer voltage (primary transfer bias) being a direct-current voltage having the polarity opposite to the normal charging polarity of the toner is applied through the primary transfer roller 52 to the intermediate transfer belt 51 that is in contact with the photosensitive drum 1. Moreover, the toner image having been primarily transferred onto the intermediate transfer belt 51 is secondarily transferred onto the recording material P that is conveyed while being sandwiched between the intermediate transfer belt 51 and the secondary transfer outer roller 54. At the time of the secondary transfer, for example, a secondary transfer voltage (secondary transfer bias) being a direct-current voltage having the polarity opposite to the normal charging polarity of the toner is applied to the secondary transfer outer roller 54. Although illustration is omitted in FIG. 8, in many cases, the intermediate transfer method is used for a so-called tandem-type color image forming apparatus in which a plurality of photosensitive drums 1 (and process units arranged around each photosensitive drum 1) are arranged along a movement direction of a surface of the intermediate transfer belt 51.

In the case of such image forming apparatus 100 using the intermediate transfer method, when the intermediate transfer belt 51 and the photosensitive drum 1 are in contact with each other at the time of the start-up operation, the toner having moved onto the photosensitive drum 1 due to the start-up fog adheres to the intermediate transfer belt 51. Then, the toner adheres to the secondary transfer outer roller 54 to cause the dirt on the back of the recording material P, and an additional cleaning sequence for the intermediate transfer belt 51 for suppressing the adhesion of toner may be required. Moreover, when a voltage is simply applied through the primary transfer roller 52 to the intermediate transfer belt 51 to suppress the adhesion of the toner to the intermediate transfer belt 51, there arises a problem caused by the increase in the electrostatic adhesion force of the toner with respect to the photosensitive drum 1 as in the case mentioned above. Therefore, through application of the present disclosure also to the image forming apparatus 100 using the intermediate transfer method, the same effect as that of the above-mentioned embodiments can be obtained.

Moreover, similarly, the present disclosure is applicable also to an image forming apparatus including, in place of the intermediate transfer member provided in the image forming apparatus using the intermediate transfer method described above, a recording-material bearing member such as a recording-material bearing belt formed of an endless belt. In this image forming apparatus, the toner image having been formed on the photosensitive member is borne on the recording-material bearing member and conveyed through application of a transfer voltage (transfer bias) to the recording-material bearing member via a voltage application member (for example, transfer roller) to be transferred to the recording-material. In this image forming apparatus, the recording-material bearing member forms the transfer member that is in contact with the photosensitive member at the transfer position in the rotation direction of the photosensitive member for transferring the toner image on the photosensitive member to the recording material.

Also in the case of such image forming apparatus including the recording-material bearing member, similarly to the case of the image forming apparatus using the intermediate transfer method described above, when the recording-material bearing member and the photosensitive member are in contact with each other at the time of the start-up operation, the toner having moved onto the photosensitive member due to the start-up fog adheres to the recording-material bearing member. Then, the toner causes the dirt on the back of the recording material, and an additional cleaning sequence for the recording-material bearing member for suppressing the adhesion of toner may be required. Moreover, when a voltage is simply applied through a voltage application member to the recording-material bearing member to suppress the adhesion of the toner to the recording-material bearing member, there arises a problem caused by the increase in the electrostatic adhesion force of the toner with respect to the photosensitive drum as in the case mentioned above. Therefore, through application of the present disclosure also to the image forming apparatus described above, the same effect as that of the above-mentioned embodiments can be obtained.

Moreover, in the above-mentioned embodiments, the development member is arranged in contact with the photosensitive member. However, the start-up fog may occur even with the configuration in which the development member is arranged close to the photosensitive member. Therefore, through application of the present disclosure also to the image forming apparatus having the configuration in which the development member is arranged close to the photosensitive member, the same effect as that of the above-mentioned embodiments can be obtained. However, it can be said that the action of the present disclosure may be achieved more remarkably in the configuration in which the development member is in contact with the photosensitive member during the period in which the surface of the photosensitive member that is not charged at the time of the start-up operation, which is more liable to cause the start-up fog, passes through the development position.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

What is claimed is:

1. An image forming apparatus, comprising:

a photosensitive member which is rotatable;

a charging member configured to charge a surface of the photosensitive member and disposed at a charging position with respect to a rotation direction of the photosensitive member;

a developing device including a developing member, which is rotatable, disposed opposite to the photosensitive member at a developing position with respect to the rotation direction of the photosensitive member and configured to bear toner, wherein the developing device is configured to supply the toner on the developing member to an electrostatic image on the photosensitive member to form a toner image on the photosensitive member at the developing position;

a transfer member which is urged toward the photosensitive member at a transfer position with respect to the rotation direction of the photosensitive member;

a developing power source configured to apply a developing voltage to the developing member;

a transfer power source configured to apply a transfer voltage to the transfer member; and a control unit configured to control the developing power source and the transfer power source, wherein, when the photosensitive member transitions from a first state in which the photosensitive member is stopped to a second state in which the photosensitive member rotates, the surface of the photosensitive member is in contact with a surface of the developing member at the developing position and the surface of the photosensitive member is in contact with a surface of the transfer member at the transfer position, wherein, at a start time of a start-up operation at a time of starting an image forming operation, on the surface of the photosensitive member, a first position coincides with the charging position, a second position coincides with the developing position, and a third position coincides with the transfer position, wherein the developing device is configured to collect the toner on the photosensitive member having passed the third position, and wherein, in a state where the developing voltage having a polarity opposite to a normal charging polarity of the toner is applied to the developing member by the developing power source, during a period in which an area on the photosensitive member located downstream of the first position and upstream of the third position with respect to the rotation direction of the photosensitive member passes the third position, the control unit performs control of applying a first voltage having a same polarity as the normal charging polarity of the toner to the transfer member by the transfer power source.

2. The image forming apparatus according to claim 1, further comprising a regulation member disposed at a regulating position with respect to a rotation direction of the developing member and configured to regulate the toner on the developing member, wherein the developing device performs supply of the toner on the developing member which is regulated by the regulation member and conveyed to a supply position with respect to the rotation direction of the developing member, wherein, at the start time of the start-up operation at the time of starting the image forming operation, on the surface of the developing member, a fourth position coincides with the regulating position, and a fifth position coincides with the supply position, and wherein the control unit is configured to control a predetermined timing such that the predetermined timing matches with a timing at which the second position on the photosensitive member first arrives at the third position after starting the start-up operation when the fourth position on the developing member first arrives at the fifth position after starting the start-up operation.

3. The image forming apparatus according to claim 1, wherein, during a period in which the area on the photosensitive member located downstream of the first position and upstream of the second position with respect to the rotation direction of the photosensitive member passes the second position, the control unit performs control of not applying the developing voltage to the developing member by the developing power source or applying a developing voltage having the same polarity as the normal charging polarity of the toner.

4. The image forming apparatus according to claim 1, wherein the first voltage is a voltage having an absolute value equal to or larger than a discharge threshold with respect to a surface potential of the photosensitive member, and a second voltage is a voltage having an absolute value less than the discharge threshold with respect to the surface potential of the photosensitive member.

5. The image forming apparatus according to claim 1, wherein the transfer power source applies a voltage having the polarity opposite to the normal charging polarity of the toner to the transfer member so that the toner image is transferred from the photosensitive member to a recording material which passes a contact portion between the photosensitive member and the transfer member.

6. The image forming apparatus according to claim 1, further comprising an intermediate transfer member to which the toner image is to be transferred from the photosensitive member, wherein the transfer member is configured to urge the intermediate transfer member toward the photosensitive member and apply a voltage having the polarity opposite to the normal charging polarity of the toner from the transfer power source to the transfer member to transfer the toner image from the photosensitive member to the intermediate transfer member.

7. The image forming apparatus according to claim 1, further comprising a cleaning member, which is in abutment against the photosensitive member downstream of the third position and upstream of the first position with respect to the rotation direction of the photosensitive member, and is configured to remove the toner from the photosensitive member.

8. The image forming apparatus according to claim 1, further comprising a charge removal unit configured to remove at least a part of a charge on the surface of the photosensitive member downstream of the third position and upstream of the first position with respect to the rotation direction of the photosensitive member.

9. The image forming apparatus according to claim 1, wherein the developing member is in abutment against the photosensitive member during a period in which the area on the photosensitive member located downstream of the first position and upstream of the second position with respect to the rotation direction of the photosensitive member passes the second position.

10. The image forming apparatus according to claim 1, wherein the transfer member is in abutment against the photosensitive member during a period in which the area on the photosensitive member located downstream of the first position and upstream of the third position with respect to the rotation direction of the photosensitive member passes the third position.

11. The image forming apparatus according to claim 1, wherein the control unit performs control of applying the first voltage to the transfer member by the transfer power source during a non-image forming operation performed before an image forming operation is performed.

12. The image forming apparatus according to claim 1, wherein the toner is composed of a one-component developer.

* * * * *